US007246767B2

(12) United States Patent
Castellani

(10) Patent No.: US 7,246,767 B2
(45) Date of Patent: Jul. 24, 2007

(54) WINDING MACHINE FOR ROLLED OR DRAWN WIRE/ROD WITH A TURN CLUTCH DEVICE FOR AUTOMATIC WINDING

(75) Inventor: Federico Castellani, Tarcento (IT)

(73) Assignee: S.I.M.A.C. S.p.A. (IT)

( * ) Notice: Subject to any disclaimer, the term of this patent is extended or adjusted under 35 U.S.C. 154(b) by 0 days.

(21) Appl. No.: 11/515,612

(22) Filed: Sep. 5, 2006

(65) Prior Publication Data

US 2007/0001049 A1 Jan. 4, 2007

Related U.S. Application Data

(63) Continuation of application No. PCT/IT2005/000105, filed on Feb. 25, 2005.

(30) Foreign Application Priority Data

Mar. 3, 2004 (IT) ..... UD2004A0037

(51) Int. Cl.
*B65H 65/00* (2006.01)

(52) U.S. Cl. ..... 242/476.6; 242/172; 242/362; 242/586; 242/587.2; 242/597.3; 72/135

(58) Field of Classification Search ..... 242/362, 242/474.4, 476.1, 586, 587.2, 476.5, 476.6, 242/587, 597.3, 172
See application file for complete search history.

(56) References Cited

U.S. PATENT DOCUMENTS 464,234 A * 12/1891 Weeks ..... 242/597.3
1,056,410 A * 3/1913 Gochik ..... 242/571.5
1,823,990 A * 9/1931 Sanderson ..... 242/362.1
3,592,399 A 7/1971 Woodrow ..... 242/25
3,945,585 A 3/1976 Moslener ..... 242/81
4,664,329 A 5/1987 Pali ..... 242/78
5,409,180 A * 4/1995 Stewing ..... 242/584
6,666,398 B2 * 12/2003 Allegretto et al. ..... 242/476.6

FOREIGN PATENT DOCUMENTS

| | | |
|---|---|---|
| DE | 821 666 | 11/1951 |
| DE | 1 173 760 | 7/1964 |
| DE | 2 027 516 | 2/1971 |
| EP | 1 126 934 | 8/2001 |
| GB | 901527 | 7/1962 |
| GB | 2 058 703 | 4/1981 |

OTHER PUBLICATIONS

International Search Report, May 20, 2005, 3 pages.

* cited by examiner

*Primary Examiner*—Patrick Mackey
*Assistant Examiner*—William E. Dondero
(74) *Attorney, Agent, or Firm*—St. Onge Steward Johnston & Reens LLC

(57) ABSTRACT

Winding machine for rolled or drawn wire/rod with turn clutch device for automatic winding of the type comprising a reel with a mandrel and base flange and an external mobile containment counter flange, wherein the counter flange is openable to allow the axial extraction from the mandrel of the reel of the completed coil, the flange of base comprising a recess to receive the head of the wire/rod to be wound, with an overturned trapezoidal annular recess with corresponding reduction towards the base for auto-clamping the wire/rod to start winding without requiring pincers.

12 Claims, 7 Drawing Sheets

WINDING MACHINE FOR ROLLED OR DRAWN WIRE/ROD WITH A TURN CLUTCH DEVICE FOR AUTOMATIC WINDING

CROSS-REFERENCE TO RELATED APPLICATIONS

The present application is a continuation of pending International patent application PCT/IT2005/000105 filed on Feb. 25, 2005 which designates the United States and claims priority from Italian patent application UD2004A000037 filed on Mar. 3, 2004, the content of which is incorporated herein by reference.

FIELD OF THE INVENTION

This invention refers to a winding machine for rolled or drawn wire/rod with a turn clutch device for automatic winding according to the characteristics of the preamble of the main claim.

BACKGROUND OF THE INVENTION

Many winding machines for rolled or drawn wire/rod with a turn clutch device are known. Some solutions are disclosed in U.S. Pat. No. 3,592,399 HAROLD E. WOODROW and GB-A-901527 CYRIL GEORGE PULLIN.

Other pertinent solutions are the following:

GB2058703 d.4/1981 is cited as an example of an automatic winder.

DE0821666 d.11/1951 describes an alternative wire/rod unwinding system with two winding reels (11,12, FIG. 8) that include a device to form wire/rod coils downstream of a wire/rod working installation, provided with a wire-guide (13/14) with wire-guide movement means (15-13) to guide the wire/rod to the respective winder (11,12) with wire/rod transportation means (17) to move the end of the wire-guide to the coil (13) on one side and on the other above the respective reel (11-12), substantially in a parallel direction to the axis of the reel mandrel.

U.S. Pat. No. 4,664,329 (May 12, 1987 in the name of Essex Group Fort Wayne Ind. US), refers to a winding system of a wire/rod segment to form a wire/rod coil that contains the stages of rotating a mandrel by means of contact of the external surface of the mandrel with a moving belt and by directing the wire/rod above the rotating mandrel between the belt and the external surface of the mandrel. The belt keeps the wire/rod against the mandrel (reel), and when the mandrel rotates, the wire/rod is wound in a coil on the external surface of the mandrel. The belt maintains contact with the external surface of the coil to rotate the mandrel until the full length of the wire/rod section is wound.

U.S. Pat. No. 3,945,585 published 23-03-1976 (DEMAG) relates to an advanced wire/rod winding system.

The U.S. Pat. No. 3,945,585 (DEMAG) describes an apparatus for on-line coiling of wire-like materials, and related method.

In the respective summary, it is affirmed that:

The disclosure relates to a coiling stand arranged to receive hot wire-like material, directly from a rolling mill or other forming mill and to wind the material into convenient coils. The coiling stand is positioned to receive wire-like material tangentially, and includes a novel and highly effective sleeve-like guide bell, which surrounds a portion of the spool. As a fresh end of hot wire-like material leaves the coil stand at high speed and approaches the coiling stand, it is directed into the space between the spool and the surrounding guide bell. The leading end of the material is thus captured and guided to the desired position, as the winding operation is initiated. As soon as a few convolutions of the coil are wound, the guide bell may be retracted axially. Desirably, however, it is not fully retracted, but continues to isolate the initial one or two convolutions, for easy subsequent access. The new coiling stand also includes provisions for advancing the guide bell axially over the spool, at the conclusion of a winding operation, to strip the just-wound coil from the spool. The new system is simplified, yet extremely efficient and reliable.

In the respective description it is said as in the background art that:

In the operation of modern, high speed rolling mills, for the production of wire and similar rolled steel products, it is important to provide for the on-line winding of the wire-like material, as it is discharged at high speed and in a hot condition from the forming mill. In this connection, the efficient performance of the rolling mill is dependent, to a large extent, on the performance of the coiling equipment at the discharge end. Any malfunction or other discontinuity in the operation of the coiling device will entail an interruption in the operation of the entire rolling mill. It is therefore important to utilize coiling devices of a highly reliable and efficient nature, and which are capable of a relatively high coiling capacity.

One known mechanism for the purpose is the so-called Edenborn winder, in which the wire-like material is first guided through a revolving pipe and is directed by the pipe into a receiving basket. The Edenborn equipment, however, has certain significant limitations with respect to speed. Thus, with increasing speeds of discharge from the rolling mill, the friction of the material in passing through the pipe may exceed the stability of the still-hot material discharged from the mill. When this occurs, the wire-like material folds up at the entry end of the pipe, requiring the shut down of the entire line while the ensuing mess is cleared.

Another known prior art device is the so-called Garret winder, in which the wire-like material is directed more or less tangentially into a basket-like container, which is being rotated at a speed appropriate to the discharge of the material from the forming mill. The basket-like container usually consists of a bottom plate and a plurality of distributed vertical rods forming the circumference of the container. A combination of gravity and centrifugal force is utilized to form the coil in the container in coiling operations. One significant shortcoming of the Garret-type winder concerns the fact that, with high speed forming mills, the basket-like container must be rotated at high speed, and the centrifugal forces involved cause the vertical rods, forming the circumference of the basket, to bend outward. Consequently, this type of equipment can only be used effectively at relatively lower speed. The utilization of a solid container, while it would avoid the problem caused by centrifugal deflection, introduces difficulties in connection with the coiling operation, and also involves excessive momentum in the rotating container, resulting in unfavorable economical considerations.

Both of the above described, previously known types of equipment have a characteristic disadvantage of providing poor coil density and uniformity, occasioned by the fact that the wire is directed into the receiving container in a more or less random manner. This can result in significant difficulties when unwinding the wire for further processing, as the convolutions of disorderly coils often become entangled.

While it is known to be desirable to wind coils in uniform layers on the exterior of a spool, and winding stands of this nature are well known, there has been no practical such device having an efficient capability of picking up the fresh end of a wire-like material arriving at high speed from a high speed rolling mill. One known device of the last described type includes a winding spool arranged to receive material moving in an axial direction. The means for engaging the fresh end of rapidly moving material includes a clamping device, surrounding one end of the spool, and a guide for engaging the fresh end of material and leading it toward and into the clamping device. This is disclosed in German publication No. 2,027,516. A serious limitation of such equipment, however, is that, when the hot, rapidly moving material is first introduced into the guide means, the axially moving wire-like material engages an axially stationary guide wall. The friction occasioned by this relative movement frequently causes the still hot and relatively unstable wire-like material to fold up, requiring the processing line to be shut down.

The same document describes the proposed solution as follows:

In accordance with the present invention, a new coiling apparatus and procedure is provided which eliminates the important disadvantages of the known prior art devices, enabling wire-like material to be efficiently wound in an on-line basis as it comes directly from a high speed forming mill. The equipment of the invention is simple, rugged, yet highly efficient, enabling the forming of highly uniform, dense coils of relatively large size, such that the rolling mills may be kept in operation with an optimum efficiency.

Pursuant to the invention, a winding spool is arranged generally at right angles to the line of advance of the wire-like material, as it is discharged from the rolling mill or other forming mill. The spool is arranged to be operated at a speed just slightly greater than the normal speed of advance of the material, in order to maintain a slight tension during the wind-up. As a significant feature of the invention, a novel guide bell arrangement is provided at one axial end of the spool. The guide bell is rotatable with the spool, but is axially displaceable along the spool in the performance of its function. Thus, in a "start" position, the guide bell surrounds one end portion of the spool, providing an annular recess of a thickness somewhat greater than one layer of the material. The outer end of the guide bell is flared upwardly, to facilitate the insertion into the annular space of a fresh end of the wire-like material at the start of a wind-up operation. The guide bell thereafter is retractable, to accommodate winding of large, heavy coil.

In accordance with another and more specific aspect of the invention, the guide bell is of a two part construction, consisting of an inner sleeve-like member and an outer sleeve-like member. The outer sleeve-like member forms the principal guide means to receive the incoming fresh end of material, while the inner sleeve-like member serves to confine axially the end of the material, in order to locate the initial convolution. The two parts of the guide bell are axially displaceable, independent of each other, enabling the outer sleeve to be axially retracted, without moving the inner member, immediately after the start up of a winding operation. At the end of a winding operation, both parts of the guide bell may be axially moved together, for stripping off the wound coil from the wind-up spool.

The Figure clearly shows the device with the included description of said document:

Referring now to the drawing, the numeral 1 represents a spindle shaft, which is supported by suitable bearings 5 in a housing 4. One end of the spindle shaft projects outwardly from the housing 4 and mounts a plurality of spool drum segments 2 which, in the aggregate, form a winding spool. The spool segments 2 are mounted for limited radial movement, by means of an actuator slide 3. The full lines show the spool segments in their normal, expanded positions. The dotted lines, located a short distance radially inward, reflect the radially retracted positions of the spool segments.

Appropriate means of a well known type (not shown) may be provided for controlling the position of the slide 3, as will be appreciated. In the illustrated arrangement, the actuator slide 3 is mounted on the outer end extremity 12 of the spindle shaft for limited sliding movement, while the spool segments 2 are slideably engaged with inclined surfaces 13 of the slide. Radial guide ways 14, at the inner end of the spool segments 2, cooperate with similar guides in a fixed collar 15, carried by the spindle shaft, to assist in guiding and supporting the spool segments 2.

The collar 15 is fixed to the shaft 1 and has a rearwardly extending flange 16 forming a cylindrical outer surface 17. In the illustrated arrangement, the surface 17 of the flange has a diameter between the expanded and retracted diameters of the spool segments 2.

Slideably supported on the cylindrical flange 16 is a sleeve-like member **6*b*, forming part of a two-part guide bell assembly 6. At its forward end, the sleeve member 6*b* has an abutment surface 18 arranged, in a normal or retracted position of the sleeve 6*b*, to lie close to the end surface of the spool segments 2. At its inner or rear end, the sleeve member 6*b*, is provided with an annular groove 19 receiving an operating member 8. In conjunction with suitable means (not shown), the operating member 8 serves to slide the sleeve-like member 6*b* axially with respect to the spindle shaft. An outer sleeve-like member 6*a* of the guide bell assembly is slideably supported on surface 20 of the inner sleeve 6*b*. The rearward end of the sleeve is annularly recessed at 21, to receive an operating member 7, by means of which the outer sleeve 6*a* may be advanced or retracted axially on the inner sleeve 6*b***, between the advance position shown in the upper portion of the drawing and the retracted position shown in the lower portion of the drawing.

At its outer extremity, the sleeve **6*a* is provided with an outwardly flaring guide surface 10, which merges into a cylindrical inner confining surface 11. As reflected in the drawing, the diameter of the cylindrical confining surface 11 exceeds the retracted diameter (dotted lines) of the winding spool by an amount which somewhat exceeds the diameter of the wire-like element 9 to be wound on the spindle. The length of the outer sleeve member 6*a* is such that, in a retracted position, its forward extremity projects slightly beyond the abutment 18** of the inner sleeve, as reflected in the lower portion of the drawing.

In the operation of the coiling stand shown in the drawing, the spindle 1 is initially set into rotation, having a rotational speed such that the winding speed tends to exceed slightly the oncoming speed of the wire-like material, as it is discharged from the last stand of the rolling mill. The spool segments 2, initially, are in a retracted position, at the diameter reflected in the dotted lines in the drawing. Likewise, the outer sleeve **6*a* of the guide bell assembly is actuated to its advanced or projected position, as reflected in the upper part of the drawing. This forms an annular recess at the inner end of the spool assembly 2, defined in part by the radially retracted spool segments, the confining surface 11, and the abutment surface 18. The width of the recess is somewhat in excess of the diameter of the wire-like material 9**, as shown.

The positioned relationship of the rolling mill and winding stand is such that the incoming fresh end of material advances towards the spindle generally tangentially with respect to the outer surface and with an axial component directed towards the recessed end of the spool. As the end reaches the guide bell assembly 6, it is directed by the flaring surface 10 into the recess and eventually into contact with the abutment surface 18. As the leading end 9*a* of the wire is captured in the recess, it will commence to rotate around the spool, being confined by the cylindrical surface 11 of the sleeve member 6*a* and being held there against by centrifugal force.

After the first few turns of the coil, the actuator 7 is operated to drive the sleeve 6*a* to its retracted position, and simultaneously the slide 3 is shifted to expand the spool segments 2 to the enlarged diameter indicated in full lines in the drawing. Thereafter, the winding operation proceeds, with successive convolutions of the wire-like material being laid side-by-side in the first course, and similarly in successive courses until the desired size of coil is achieved. The suitable level wind guide means (not shown but of conventional construction) may be provided to guide the wire-like material during the main portion of the coil winding operation.

As reflected in the lower portion of the drawing, at least the forward extremity of the outer sleeve 6*a* projects slightly beyond the abutment surface 18, even in a retracted position of the outer sleeve. This tends to isolate and protect the first one or two convolutions of the coil, during the subsequent portions of the winding operation, so that these convolutions are in a known position and easily accessible in the wound coil.

When a coil 9*b* has been completed, it may be stripped from the spindle by moving the slide 3 outwardly, to retract the spool segments 2, and thereafter advancing axially the guide bell assembly 6*a* 6*b*, pushing the wound coil ahead of it off of the spindle in the manner desired.

The apparatus and procedure of the invention enables dense, compact coils to be wound in an orderly fashion and in a highly reliable manner. The advantage of this are twofold, in that, on the one hand, the rolling operation may be carried on with greater continuity and therefore greater efficiency, because of the significant reliability of the coil winding process, and, on the other hand, a more orderly coil is achieved, in that the successive convolutions may be laid out without entanglement. Also, the initial convolution is in a known position, easily accessible for subsequent paying out of the coil and/or butt welding of the successive coils, for example.

One of the advantageous features of the invention resides in the use of a retractable guide bell arrangement, which initially partly surrounds the winding spool at one end. An incoming end of rapidly moving wire-like element is directed tangentially and with a slight axial component into an annular recess formed in part by the guide bell. The bell guides the fresh end into the proper starting position and confines it temporarily, for the first few convolutions of the winding operation. Thereafter, it is retracted, and winding of the coil continues under slight tension by appropriate driving of the spool. Conveniently, the guide bell assembly is utilized at the conclusion of the coil winding operation to strip the coil axially from the winding spindle.

The aforementioned solution therefore anticipates a gripper system of the wire/rod end whose first turns are wound in a recess or groove in the base flange (6) of the winding mandrel, in this specific case said base flange (6) is also axially mobile to allow both the clamping in a first instance then, with withdrawal, the completion of the winding of the coil and finally the extraction of the finished coil in a final stage with its movement towards the exterior (expulsion of the coil).

The above clearly demonstrates the notoriety of the use of a groove for the insertion of the wire/rod at the start of winding associated with gripper systems determined by the movement of the cover over the first turns wound in the groove.

Notwithstanding, the solution to the problem to be solved is substantially identified in the title, namely the concept of a valid turn clutch device.

In fact, it is known as described above that in automatic winding particularly at high-speed, a problem appears with respect to the clutching of the wire/rod in the reel mandrel of the winding-machine in order to form the first turn or turns around the mandrel of the winder, in which the subsequent formation of the turns allows a secure grip with the aim of suitable and controlled tensioning with the pulling of the wire/rod for a correct spiral winding of one turn next to another, avoiding the danger that the first turn will become spaced apart and therefore the start of winding is prevented, which would obviously cause the stoppage of the installation with the consequent serious production losses.

The solution of clamping in the groove of the first turn(s) is consequently deemed necessary and furthermore avoids the aforementioned problems. As it can be an object of protection only, said clamping or seizing of the wire/rod is carried out at the beginning of the winding.

These clamping systems are complex and expensive and require complicated movement mechanisms.

SUMMARY OF THE INVENTION

The aim of this invention is to simplify these mechanisms and allow the winding of the first forming turns of the coil from the wire/rod end that is guided for winding, without clamping mechanisms that notoriously can cause tangles and inconveniences at the beginning of the winding of the coil, therefore obliging the stoppage of a very expensive in-line wire/rod production plant.

The problem is solved with a winding machine for rolled or drawn wire/rod with turn clutch device for automatic winding, of the type comprising a reel with mandrel and base flange and an external mobile containment counter flange, wherein the counter flange is openable to allow the axial extraction from the reel mandrel of the completed coil, the base flange comprising a substantially annular recess to receive the head of the wire/rod to be wound characterized in that:

i—said recess is formed by means of a continuous or discontinuous base rib, placed annularly projecting from the internal surface of said base flange;

ii—said recess having a form with a section that substantially tightens toward the bottom, with an external entrance width equal to or greater than the diameter of the wire/rod and an internal base width lower than said diameter of the wire/rod, so that the wire/rod can enter into said recess but cannot reach the bottom if not forced;

iii—on the opposite side to said base rib, on the mandrel side tilted ribs and/or a spiral course are provided that push by rolling and sliding said entrance wire/rod within said recess and toward the bottom of said recess, so that with the cooperation of the form of slight traction of the mandrel-coil said wire/rod is engaged by auto-clamping in said recess by its end and therefore is clamped by the formation of the first turn and by the following without slackening.

In this way, thanks to the presence of the groove with an overturned trapezoidal entrance, aided by the spiroidal ribs inviting the wire/rod to go towards the bottom of the groove where it is automatically tightened through auto-tensioning by increasingly tightening and clamping the wire/rod end of the coil in winding around the reel mandrel without clamping mechanisms, a considerable simplification of the system is obtained, requiring only wire-guide entrance jaws adhered to the bottom of the mandrel that are then withdrawn.

The coil extraction system is then facilitated by the re-entry of sectors of the cylindrical mandrel that are tightened towards the exterior thus giving the mandrel a uniform spindle form.

The coil is easily extractable without extraction means by means of the presence of crosswise opposite incisions in the base flange that allow external opposite securing and by the lower part of the coil itself for its elevation with an upwards vertical axial movement.

Said base ring that is in the form of an annular rib in sectors is shaped in an interchangeable way in order to adapt to the diameter of the wire/rod of the coil that is to be produced.

In fact, the distance and form of the rib that constitutes said recess (trapezoidal form) of the cuneiform clamping of the wire/rod varies for the interchangeability of the component sectors that form said rib.

This is necessary since the annular projection/overhang must fall between two turns of the coil to facilitate the complete compaction of the coil otherwise the second and third layer of turns would not be perfectly compact.

Instead, if the form and distance of said rib on the base flange of the reel is in the suitable shape, namely:

axially spaced from the external diameter of the mandrel, axially by a diameter and a half of wire/rod and with a thickness no greater than the diameter of the wire, and with a projection no greater than the diameter of the wire/rod itself (preferably smaller), it is evident that the rib will not obstruct in any shape or form the shape of the coil that will later be extracted in a finished state from above.

BRIEF DESCRIPTION OF THE DRAWINGS

The invention is now described in more detail with the aid of the enclosed drawings that show a preferred embodiment, wherein.

DETAILED DESCRIPTION OF THE INVENTION

Figure 1:
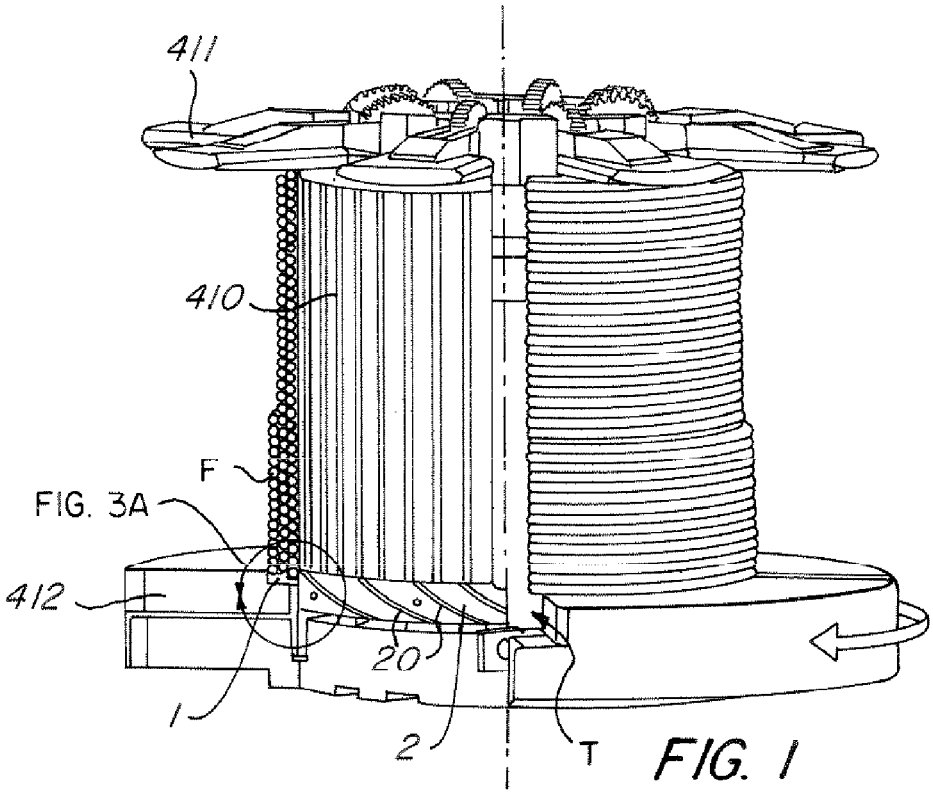
FIG. 1 represents a perspective view of the winding machine/coiler, in particular of the winding reel in axial half section in the winding stage with a view of the clamping means of the first winding turn of the wire/rod by the winder.
Figure 3A:
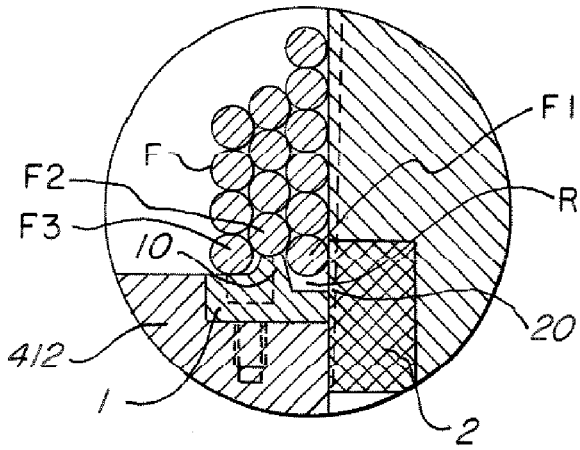
FIGS. 3A, 3B represent an enlarged cross-section of FIGS. 1 and 2, the area of the interchangeable rib at the base of flanging of the reel, where it can clearly be seen how the rib intercalates thus interpenetrating the second layer of turns, therefore without substantially distancing the second layer of wire/rod turns while the third layer of wire/rod turns is placed beyond said rib, similarly without spacing.
Figure 2:
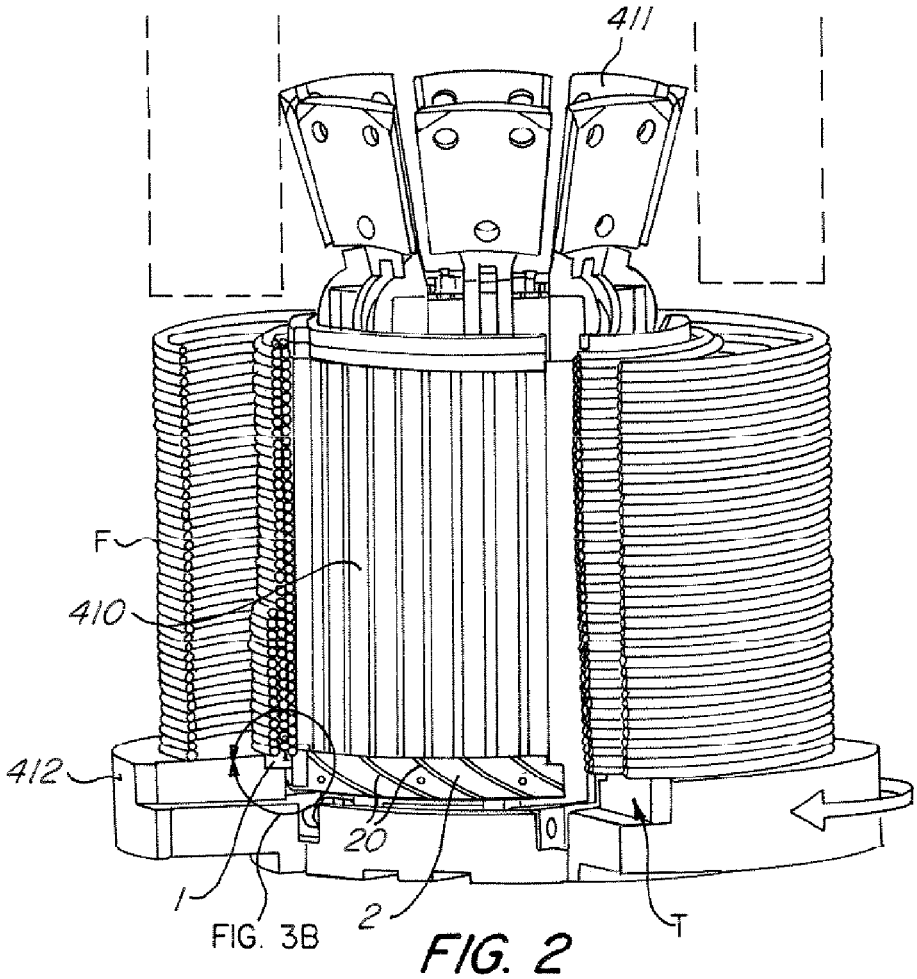
FIG. 2 represents the same solution as FIG. 1 but with the coil completely wound and the upper flange of the reel rotated with its radial sectors directed upwards to allow the extraction of the coil.
Figure 3B:
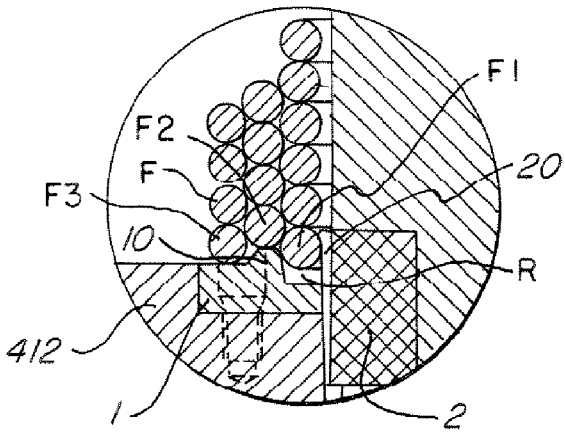
Figure 4:
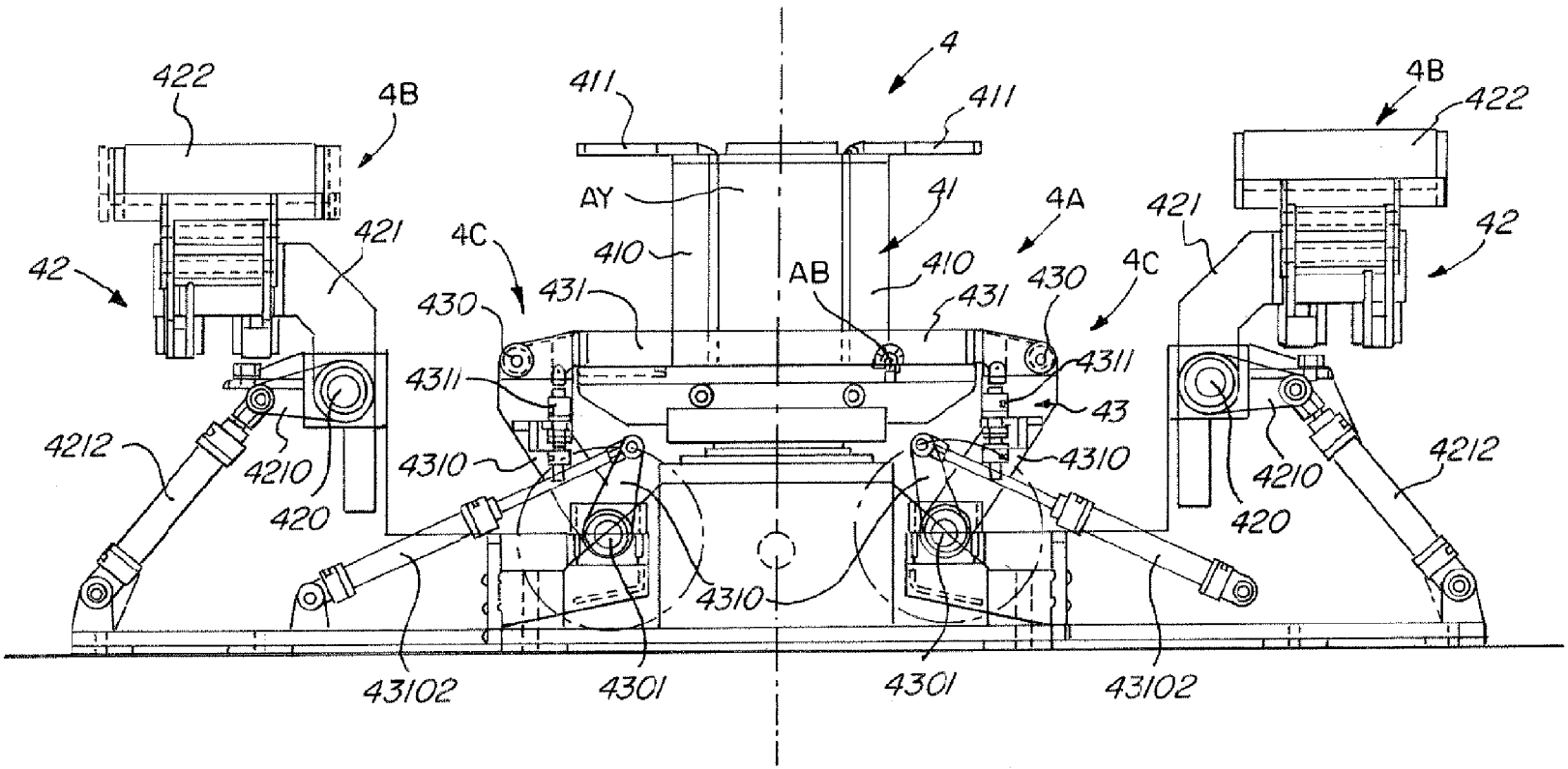
FIGS. 4 and 4*a*; represent a side view from above of the winding machine as in previous Figures, in a global schematic view, from the feed side of the wire/rod to be wound (AB), with the pair of wire-guide jaws lowered around the wire/rod winding reel to allow the automatic threading of the wire/rod originating from the respective wire-guide (3), while a pair of rollers that maintain the coil compact at the end of winding are rotated upwards at a distance from the winding coil/reel, (4B-422).
Figure 4A:
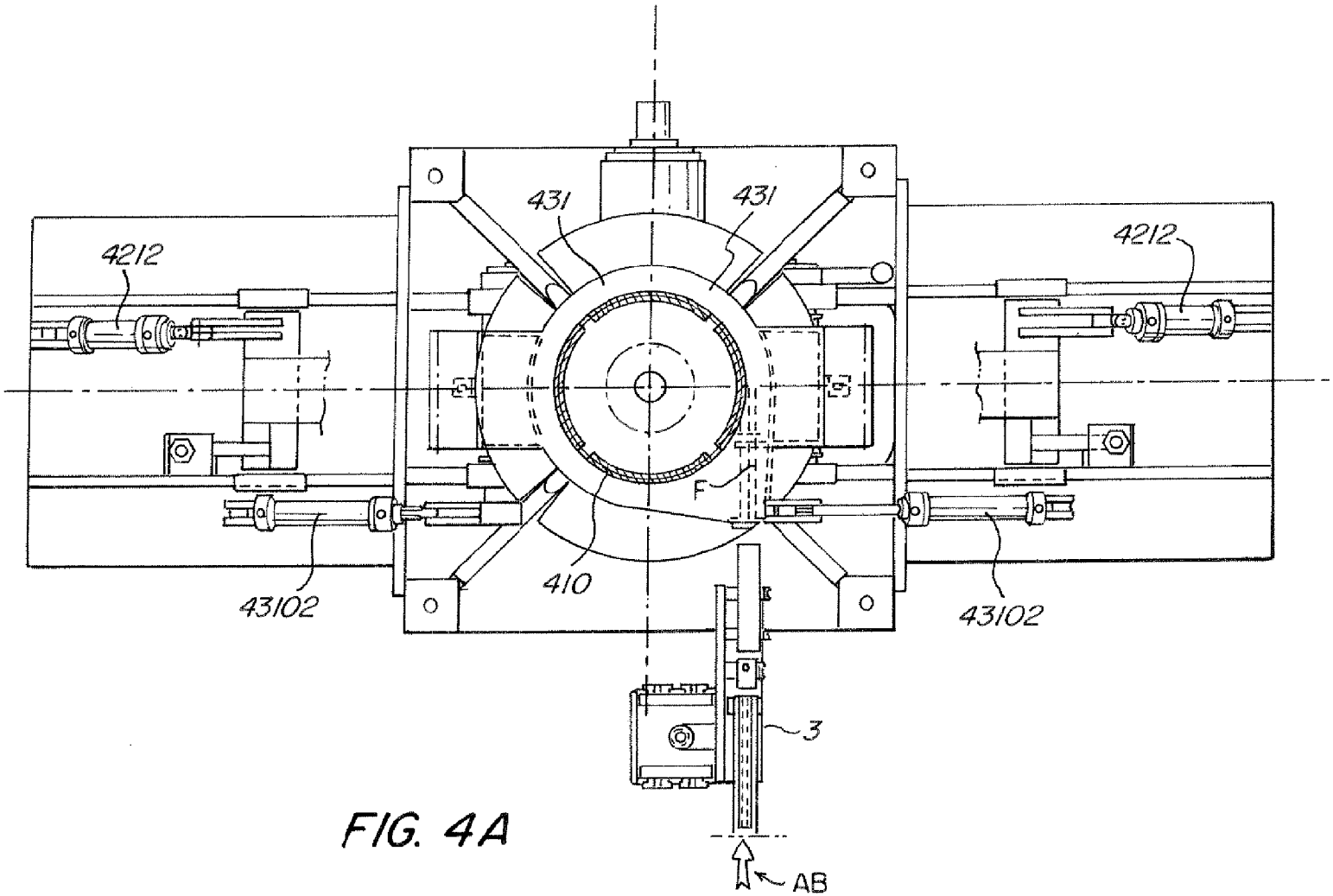
Figure 5:
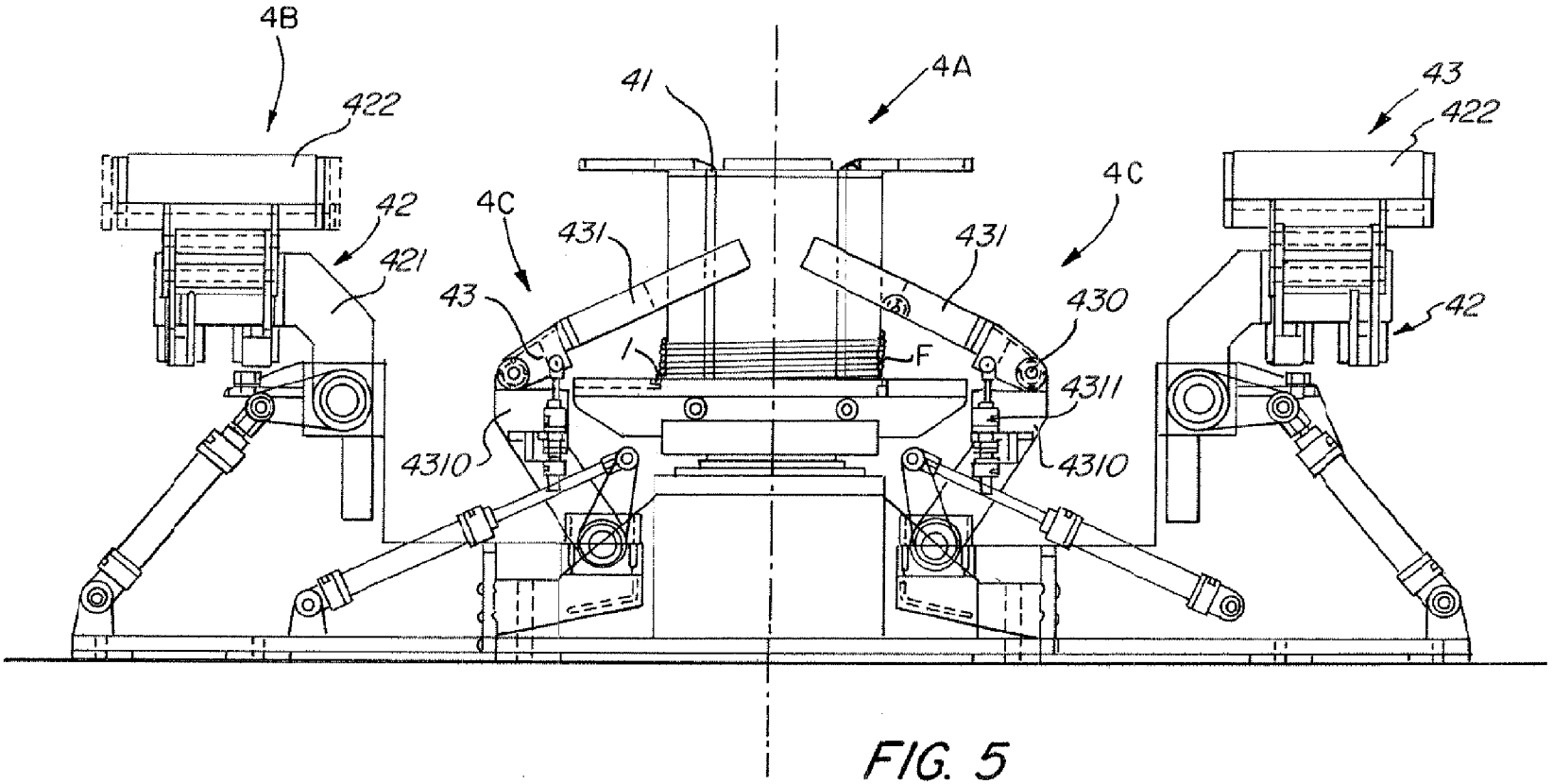
FIG. 5 represents a view of the stage immediately following the wire/rod threading and the start of winding (F), with the opposite wire-guide jaws (4C-431) immediately raised with a short disengagement movement from the previous wire-guide position, this movement is very fast because it is not integrated into the total disengagement mechanism that occurs in a subsequent stage.

Winder Groups (4,4A,4B,4C, FIGS. 4,4A,5)

There are two winding groups that are identical and adjacent with a wire-winding reel (F) with an openable coil (AV) with vertical axis.

Each group includes, in addition to the central winding reel (AV-41) with mandrel (410) with lower reel flange (412), two opposite coil containment groups (4*b*) with pairs of rollers (422) and two wire-guide jaws with automatic entry at the start of winding (4C).

In the centre is the reel (41) with openable winding coil (AV).

Opposite Coil Containment Groups (4B)

They include two respective articulated devices (42), placed on each side of the winding reel (AV) with respect to the wire/rod advancing line that enters on the side of the reel (AB).

The rollers are mounted on an articulated arm (421) hinged to the base structure (420) and operated in rotation from a distanced position (FIG. 4) to a position against the coil (B). The movement takes place by means of fluid dynamic base cylinder (4212) on a return arm (4210). Said rollers (422), are mounted in pairs on a parallelogram (4222) with a pair of opposing arms mounted on roller supports (4220) and moved elastically under pressure by respective fluid dynamic cylinder (4221) means. In this way the movement is simple and reliable and the orientation of the rolls is guaranteed to be invariable for the suitable containment of the end turns of the coil (b) on the winding reel (4V-41) to avoid slackening prior to withdrawal.

Wire Guide Group (4C)

The wire-guide group includes two opposite guide jaws with a semicircular wire/rod entrance (431) hinged to the side horizontally (430) and controlled by a fast-moving dynamic fluid cylinder (4311) at the end of the jaw movement arm (4310) hinged to the side at the base machine (4301) and rotated in distancing and approach by means of a return arm (43101) operated by a fluid dynamic base cylinder (43102).

In this way, it is understood that while with the opposite base cylinders (43102) the distancing and approach of the wire-entry guide jaws (431) is carried out, their final movement, that is precise and fast to engage the wire/rod and disengage from the wire, occurs with independent control, that is precise short and fast (4311) that is otherwise impossible with this type of performance by the approaching and distancing mover device with wide travel (43102).

The above therefore allows a very high speed to be reached and good performance to be achieved, without the danger of tangling or the need to decelerate the advancing speed of the wire/rod or use speed adapting loops. The short engaging and disengaging movement is clearly visible in FIG. 5

Figure 6:
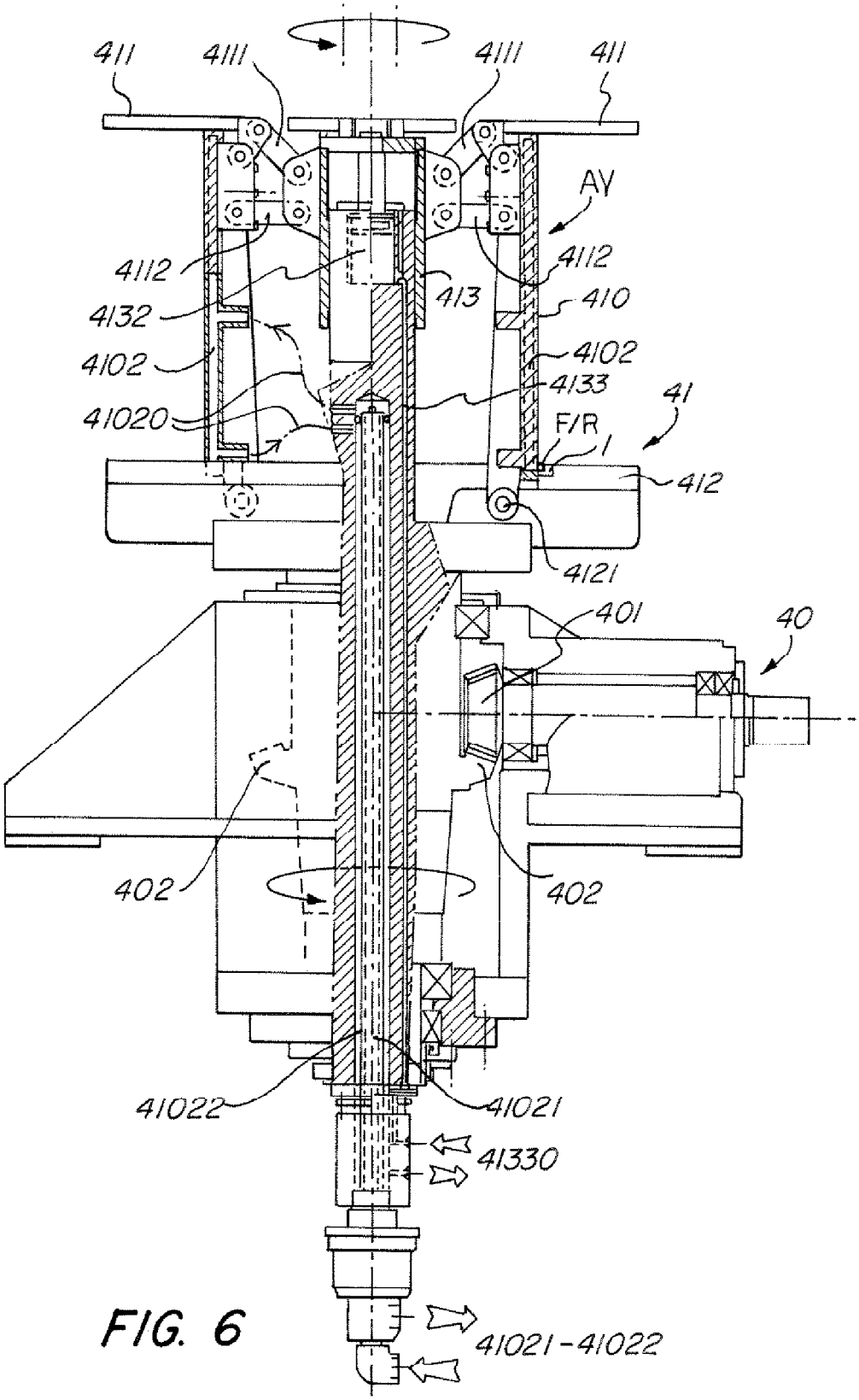
FIG. 6 represents an enlarged view of the constructive details of the wire-winding reel for the formation of the coil (winding reel), in partial axial section to show the respective moving mechanism and cooling device. Said winding reel or winding coil is in the winding position.
Figure 7:
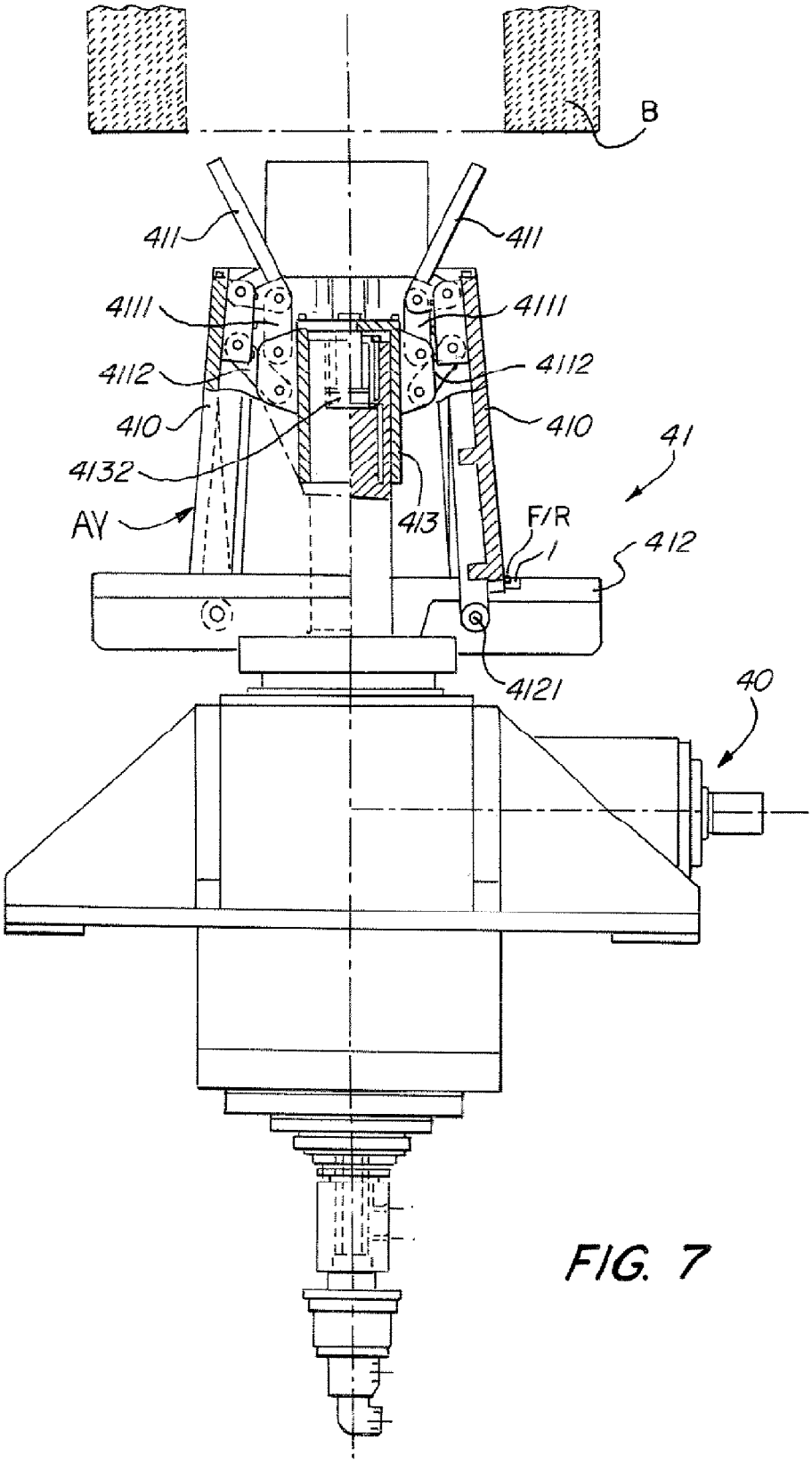
FIG. 7 represents a view of the winding reel (AV) in the previous Figure, in which in partial axial section, the moving mechanism is visible and the latter was transformed by a closed reel with a counter flanged cylindrical mandrel with a conical reel/mandrel (410) and upper flanging (411) rotated upwards, namely towards the axis and outwards to allow the axial extraction of said coil (B).

Central Winding Group—Winding reel with coil (4*a*, FIGS. 6, 7)

This comprises the central winding reel (41) with the openable and closable reel (AV), Reel Opening and Closing (AV):

The opening and closing of the Reel (AV), necessary for unthreading the coil (B) once completed, takes place by means of four flange sectors with rotatable petals (411) with a return arm (4111) moved by a sleeve (413) that is moved axially by means of dynamic fluid cylinder (4131-4132) operated by a dynamic fluid circuit (4133) with return to the reel base (41330) in a non-rotating coaxial axis with respect to the rotating reel (AV).

The advantage of this solution is relevant for compactness and simplicity, rotation being guaranteed by the shaft end connection (4131) with respect to the bushing (413).

Variation of the External Shape of the Reel Mandrel (AV)

The reel mandrel (AV) is composed of four sectors namely four pincers (410) hinged to the base (4121) of a lower reel flange coil support (412).

On the upper part the movable sectors of the reel mandrel (410) are articulated (4112) to the axially mobile bushing (413).

In this way, when the movable bushing (413) is raised the upper flanging petals (411) are open, namely orthogonal to the reel axis and allow coil formation (B) during winding, and the sectors of the reel-mandrel (410) are parallel and form a cylinder (FIG. 7).

When the coil is completed, in order to allow easy extraction, the movable internal bushing (413) withdraws downwards simultaneously activating:

the petals of the upper flanging of the reel that close upwards like a flower, the sectors of the mandrel that re-enter on the upper part (410), FIG. 6-7) determining a conical shape with the upper base being smaller than the lower base.

In this way the unthreading of the coil (B) by means of the jaws of the clamping device (522) is allowed and facilitated.

For cooling, the sectors or pincers of the semicircular reel core (410) are internally holed to form channels (4102). The channels convey on a return duct (41020) with internal conveyance and double coaxial channelling (41021, 41022). In this way the cooling of the reel is assured. Furthermore, the external shape of said pincers or core sectors is undulated by means of alternate longitudinal recesses (4101). In this way the contact of the surface of the core of the reel (AV) with the coil (B) is reduced and the circulation of air through these longitudinal recesses is facilitated. The reel (AV) rotates coaxially to the central axis by means of known art motorization with return bevel gear (40, 401-402).

Winding Cycle

The primer of coil formation takes place by means of said device with movable semicircular opposite jaws (431) in association with the wire/rod introduction system (AB) for first turns adherent to the side or base flange of the reel (AV) of the winder with the aid of the tilted helical entry ribs (20) for the penetration of the wire/rod (F) between the mandrel (410) and the annular rib (10) placed at the base of the lower flange of the reel (412) as claimed, wherein the wire/rod (F1) engages for the course of the trapezoidal annular groove (R), that clamps the wire/rod (F1) pushed by the conveying ribbings (20) to the base of the mandrel (410).

The device with opposite jaws (431) receives the wire/rod (F) from the dispenser (2-3) while it adheres to the reel core (AV) and subsequently to the primer of the first turns, it must quickly free the coil forming area. To do this with optimal efficiency, the fast movement of rapid movement is used (short rotation 4310, FIG. 5).

Subsequently, with another slower and wider rotation movement (4310-43102) the distancing of the wire-guide jaws is carried out, leaving free the space to the approach of said containment rollers of the last coil turns (422).

In this way, when the coil stops, the last turns are kept closed until the intervention of a transfer device clamp. Said clamping means have four double crosswise opposing jaws that are rotated at 45° to grasp the coil (B) between the rollers (422) and penetrate into the crossed 'T'-shaped incisions made on the upper surface of the lower flange (412), therefore under the coil to be withdrawn.

Subsequently, the rollers (422) move away and the coil (B) remains closed by the clamping device that has penetrated the incisions (T). At the same time, the reel (AV) has also opened thus tightening and closing the upper flanging petals that are oriented upwards.

In this way the closed coil is also loosed internally, the mandrel (410) being restricted upwards like a cone, and it can easily be withdrawn upwards for the transfer by means of transfer means (not shown), for example to a binder (not illustrated).

At this time the cycle is repeated by returning the primer wire-guide jaws to the position adjacent to the reel core (AV) to receive a new wire/rod (F) to be wound (FIG. 4).

The details of this invention can clearly be seen in FIGS. 1, 2, 3A, 3B.

From said figures, it is observed that on the lower flange of the reel (412) there is an annular groove® produced by a plurality of interchangeable screwed plugs (1) positioned in a ring with a projecting rib (10) that forms an inclined surface of the groove (R) on the mandrel side.

On the mandrel side, at the base of the mandrel (410) there is a ring with interchangeable screwed plugs (2) that present tilted or helical entry ribs (20). The inclination of the conveying ribs (20) is designed to extend within said annular groove that presents a trapezoidal form (R).

In this way, the wire/rod (F1) sent into this recess by the opposite wire-guide jaws (431) at the start of winding (FIG. 4) is forced into the trapezoidal groove (R), precisely from said tilted or helical entry ribs (20) and thus the wire/rod of the first turn (F1) engages in said groove (R), by means of the presence of the opposite tilted surface produced by the annular teeth (10).

Said tilted surface has a very small inclination in order to form a wire/rod engagement clamp by simple pressure-traction.

In this simply and safe way the clamping of the wire/rod head of the first turn is obtained, without requiring a blocking clamp.

Advantageously, the inclination angle of the trapezoidal groove is lower than 30° for adequate gripping, preferably lower than 15°, preferably 12°.

Excessive inclination would be an obstacle to the automatic gripping of the wire.

The wire/rod turns will continue to form and the second wire/rod turn (F2) is clamped adjacent to the first wire/rod turn (F1) maintaining better clamping, slightly higher than the first by support on the tooth (10), while the subsequent wire/rod turn (F3) returns to rest on the base surface of the lower flange (412) without therefore having any distance between the turns, the form of the rib tooth (10) being adequately shaped to adjust to the diameter of the wire/rod (10).

Obviously with wire/rod of different diameters, the rib sectors (1) will be unscrewed and substituted with other corresponding teeth (10) adequate to the new type of wire/rod (F).

Likewise, it is evident that the annular base sectors with entry ribs (2-20) are interchangeable and can be screwed. In this way, when the ribs (20) are worn they can be renewed by changing the sectors (2).

It is also possible to have more or less tilted and projecting ribs according to the type of wire/rod and in the form of a cross section for a better grip such as for example fish bone or with incident vertex towards the direction of mandrel rotation. In this way, the vertex of the rib grips the wire/rod (F1) in an improved way to convey it between the auto-clamping recess (R), without needing clamping for auto-stretching.

The tightening of the mandrel by the cylindrical shape of coil winding and a conical form (410), with a smaller end diameter towards the exterior to allow the extraction of said coil, is made using hinging at the base of the sectors in such a way that during the elevation of said conical form for extraction, said recess (R), expands to disengage, therefore releasing by clamping said wire/rod head of the first winding turn (F1).

The hinging of said sectors is therefore conveniently placed within or below said base flange (412-4121).

In this way, with the return in inclination towards the axis of the mandrel sectors, the annular recess (R) slightly expands and the coil can easily be extracted without the danger that the first underlying turn on the interior of the coil will remain tangled in the recess (R).

What is claimed is:

1. Winding machine for rolled or drawn wire/rod with turn clutch device for automatic winding, of the type comprising a reel with mandrel and base flange and an external mobile containment counter flange, wherein the counter flange is openable to allow the axial extraction from the reel mandrel of the completed coil, the base flange comprising a substantially annular recess to receive the head of the wire/rod to be wound, characterized in that:

i—said recess is formed by means of a continuous or discontinuous base rib, placed annularly projecting from an internal surface of said base flange;

ii—said recess having a form with a section that substantially tightens toward the bottom, with an external entrance width equal to or greater than the diameter of the wire/rod and an internal base width smaller than said diameter of the wire/rod, so that the wire/rod can enter into said recess but cannot reach the bottom if not forced;

iii—on the opposite side to said base rib, on the mandrel side, tilted ribs and/or a spiral course are provided that push by rolling and sliding said head of the wire/rod within said recess and toward the bottom of said recess, so that with a cooperation of the form of slight traction of the mandrel-coil said wire/rod is engaged by auto-clamping in said recess by its end and therefore is clamped by the formation of the first turn of the wire/rod and by the following turn without slackening.

2. Winding-machine according to claim 1, characterized in that said auto-clamping of the wire/rod head in said recess takes place in cooperation with a wire/rod conveyor with two opposite 'C' shaped movable jaws that in the first winding stage approach the mandrel of the reel to form a turn guide external to the mandrel and shaped in such a way as to guide and adhere the wire/rod head and its first following wire/rod section of the winding turn around said mandrel of the reel and by the first within said recess, to then withdraw and move away from the said winding start position.

3. Winding-machine according to claim 1, characterized in that said annular ribs on the base flange have interchangeable sectors with other varied dimensions to adapt to different diameters of wire/rod to be wound.

4. Winding-machine according to claim 1, characterized in that the reduced form of said annular recess is trapezoidal with a smaller internal base and is defined by at least one tilted surface at an angle lower than 30°.

5. Winding-machine according to claim 4, characterized in that the trapezoidal form of said annular recess, is defined by at least one tilted surface with an angle less than of equal to 15°.

6. Winding machine according to claim 5, characterized in that the at least one tilted surface has an angle of 12°.

7. Winding-machine according to claim 4, characterized in that the trapezoidal form of said annular recess is defined by a tilted surface in said annular ribs.

8. Winding machine according to claim 1, characterized in that said projecting annular rib for clamping the wire/rod in said recess to the base flange of said mandrel is carried out through separate and interchangeable annular sectors by the respective base flange.

9. Winding machine according to claim 1, characterized in that said ribs that are tilted or with wire/rod conveying spiroidal run in said recess, are arranged at the base of said mandrel on separate sectors screwed and interchangeable in said mandrel.

10. Winding-machine according to claim 1, characterized in that said ribs that are tilted or with wire/rod conveying spiroidal run in said recess, at the base of said mandrel have a fish bone cross section or alternatively have an incident vertex towards the rotation direction of the mandrel.

11. Winding-machine according to claim 1, characterized in that said mandrel of said reel is composed of longitudinal sectors hinged to the base and mobile in distancing and approach to an upper coil extraction end in order to take a coil winding cylindrical shape and a conical form, with a smaller end diameter towards the exterior to allow the extraction of said coil, in such a way that during the elevation of said conical form for extraction said recess extends to disengage said wire/rod head of a first winding turn, the hinging of mandrel sectors being underneath said recess, within or below said base flange.

12. Winding machine according to claim 1, characterized in that said base flange presents radial incisions on the upper surface of coil support to allow the seizing of the coil from underneath, between said base flange and said coil.

* * * * *